US005586531A

United States Patent [19]

Vittorio

[11] Patent Number: 5,586,531

[45] Date of Patent: Dec. 24, 1996

[54] ENGINE RETARDER CYCLE

[75] Inventor: David A. Vittorio, Columbus, Ind.

[73] Assignee: Cummins Engine Company, Inc., Columbus, Ind.

[21] Appl. No.: 563,615

[22] Filed: Nov. 28, 1995

[51] Int. Cl.[6] ..... F02D 39/02

[52] U.S. Cl. ..... 123/320

[58] Field of Search ..... 123/320, 321, 123/322, 323, 90.12

[56] References Cited

U.S. PATENT DOCUMENTS

| | | | |
|---|---|---|---|
| 3,367,312 | 2/1968 | Jonsson | 123/97 |
| 4,033,304 | 7/1977 | Luria | 123/78 |
| 4,153,016 | 5/1979 | Hausknecht | 123/90.15 |
| 4,572,114 | 2/1986 | Sickler | 123/21 |
| 4,592,319 | 6/1986 | Meistrick | 123/321 |
| 4,706,625 | 11/1987 | Meistrick et al. | 123/321 |
| 4,898,128 | 2/1990 | Meneely | 123/90.12 |
| 4,898,206 | 2/1990 | Meistrick et al. | 137/312.3 |
| 4,981,119 | 1/1991 | Neitz et al. | 123/321 |
| 5,146,890 | 9/1992 | Gobert et al. | 123/321 |
| 5,257,605 | 11/1993 | Pawellek et al. | 123/321 |
| 5,460,131 | 10/1995 | Usko | 123/321 |

FOREIGN PATENT DOCUMENTS

| | | | |
|---|---|---|---|
| 1250612 | 10/1971 | United Kingdom | 123/326 |
| 1279977 | 6/1972 | United Kingdom | 123/320 |

*Primary Examiner*—Raymond A. Nelli
*Attorney, Agent, or Firm*—Woodard, Emhardt, Naughton, Moriarty & McNett

[57] ABSTRACT

An improved engine retarder cycle in which the exhaust valve(s) or a dedicated retarder valve is opened during the compression stroke much earlier than in prior art retarder cycles. By opening the retarder valve earlier, the cylinder pressure is not allowed to build to as high a level as in the prior art, thereby requiring less force to push open the retarder valve. Additionally, increased retarder power is generated by increasing the charge of air that is in the cylinder during the compression stroke. This is accomplished by increasing the turbocharger boost by eliminating wasted flow in and out of the exhaust valves. The increased air mass is also created by incorporating a retarder intake event which opens the valve(s) starting at approximately mid-intake stroke and ending in the first half of the compression stroke. The result is increased retarding work and decreased mechanical loading on the engine.

20 Claims, 4 Drawing Sheets

ENGINE RETARDER CYCLE

CROSS-REFERENCE TO RELATED APPLICATIONS

The present application is related to the following copending patent applications, both of which are incorporated herein by reference in their entireties.

SOLENOID VALVE FOR COMPRESSION-TYPE ENGINE RETARDER, Ser. No. 08/275,118, filed on Jul. 14, 1994, by Steven W. Reedy and DEDICATED ROCKER LEVER AND CAM ASSEMBLY FOR A COMPRESSION BRAKING SYSTEM, filed on even date herewith by Reedy et al.

TECHNICAL FIELD OF THE INVENTION

The present invention elates in general to engine brake retarders of the compression release type and, more particularly, to an improved engine retarder cycle for such engine brake retarders.

BACKGROUND OF THE INVENTION

Engine brake retarders of the compression release type are believed to be well known in the art. These devices may be referred to as an engine brake or engine retarder, but regardless of the name, the theory of operation is basically the same. In general, such engine retarders are designed to open the exhaust valves or a special retarder valve of an internal combustion cylinder near the end of the compression stroke. As a result, the work done in compressing the intake air is not recovered during the expansion stroke, but rather is dissipated through the exhaust (and cooling) systems of the engine.

In a typical prior art engine retarder cycle, the exhaust valves, or a dedicated retarder valve for the cylinder is opened near the end of the compression stroke (approaching top dead center) and is held open at least throughout tile expansion and exhaust strokes. By opening the valve near the end of the compression stroke, the compressed air in the cylinder is bled out of the cylinder so that it will not apply as much pushing force against the cylinder during the expansion stroke. However, such an engine retarder cycle exhibits several problems. For example, by waiting until the end of the compression stroke to open the retarder valve, considerable pressure has built up within the cylinder which must be overcome by the circuit which opens the valve, thereby producing substantial mechanical loading upon the engine. Furthermore, because the prior art retarder valve remains open during the expansion stroke, a back flow of air from the exhaust manifold into the cylinder is created during the expansion stroke, which creates a force tending to push the piston down, thereby creating negative retarding work. This is obviously the opposite of the intended effect of the engine retarder cycle.

There is therefore a need ill the prior art for all improved engine retarder cycle which will reduce mechanical loading upon the engine caused by opening of the exhaust or retarder valves and which will reduce or eliminate the negative retarding work produced during the expansion stroke. The present invention is directed toward meeting these needs.

SUMMARY OF THE INVENTION

The present invention relates to an improved engine retarder cycle in which the exhaust valve(s) or a dedicated retarder valve is opened during the compression stroke much earlier than in prior art retarder cycles. By opening the retarder valve earlier, the cylinder pressure is not allowed to build to as high a level as in the prior art, thereby requiring less force to push open the retarder valve. Additionally, increased retarder power is generated by increasing the charge of air that is in the cylinder during the compression stroke. This is accomplished by increasing the turbocharger boost by eliminating wasted flow in and out of the exhaust valves. The increased air mass is also created by incorporating a retarder intake event which opens the valve(s) starting at approximately mid-intake stroke and ending in the first half of the compression stroke. The result is increased retarding work and decreased mechanical loading on the engine.

In one form of the invention, an engine retarder cycle for operation of an engine brake is disclosed, comprising the steps of: (a) beginning to open a retarder valve in an engine cylinder during a second half of a compression stroke of a piston in the engine cylinder; (b) opening the retarder valve to a maximum displacement prior to 8 top dead center position of the piston; and (c) closing the retarder valve during a first half of an expansion stroke of the piston.

In another form of the invention, an engine retarder cycle for operation of an engine brake is disclosed, comprising the steps of: (a) opening a retarder valve in an engine cylinder prior to a top dead center position of a piston in the engine cylinder; and (b) closing the retarder valve past the top dead center position substantially at a point where reverse exhaust gas flow back through the retarder valve would occur if the retarder valve were not closed.

In another form of the invention, an engine retarder cycle for operation of an engine brake is disclosed, comprising the steps of: (a) maintaining a retarder valve in an engine cylinder in a closed position during an entire exhaust stroke of a piston in the engine cylinder; (b) opening the retarder valve during an intake stroke of the piston; and (c) closing the retarder valve during a first half of a compression stroke of the piston.

In another form of the invention, an engine retarder cycle for operation of an engine brake is disclosed, comprising the steps of: (a) beginning to open a retarder valve in an engine cylinder during a second half of a compression stroke of a piston in the engine cylinder; (b) opening the retarder valve to a maximum displacement prior to a top dead center position of the piston; (c) closing the retarder valve during a first half of an expansion stroke of the piston; (d) maintaining the retarder valve in a closed position during a remainder of the expansion stroke; (e) maintaining the retarder valve in the closed position during an entire exhaust stroke of the piston; (f) opening the retarder valve during an intake stroke of the piston; and (g) closing the retarder valve during a first half of a compression stroke of the piston.

DETAILED DESCRIPTION OF THE PREFERRED EMBODIMENT

Figure 1:
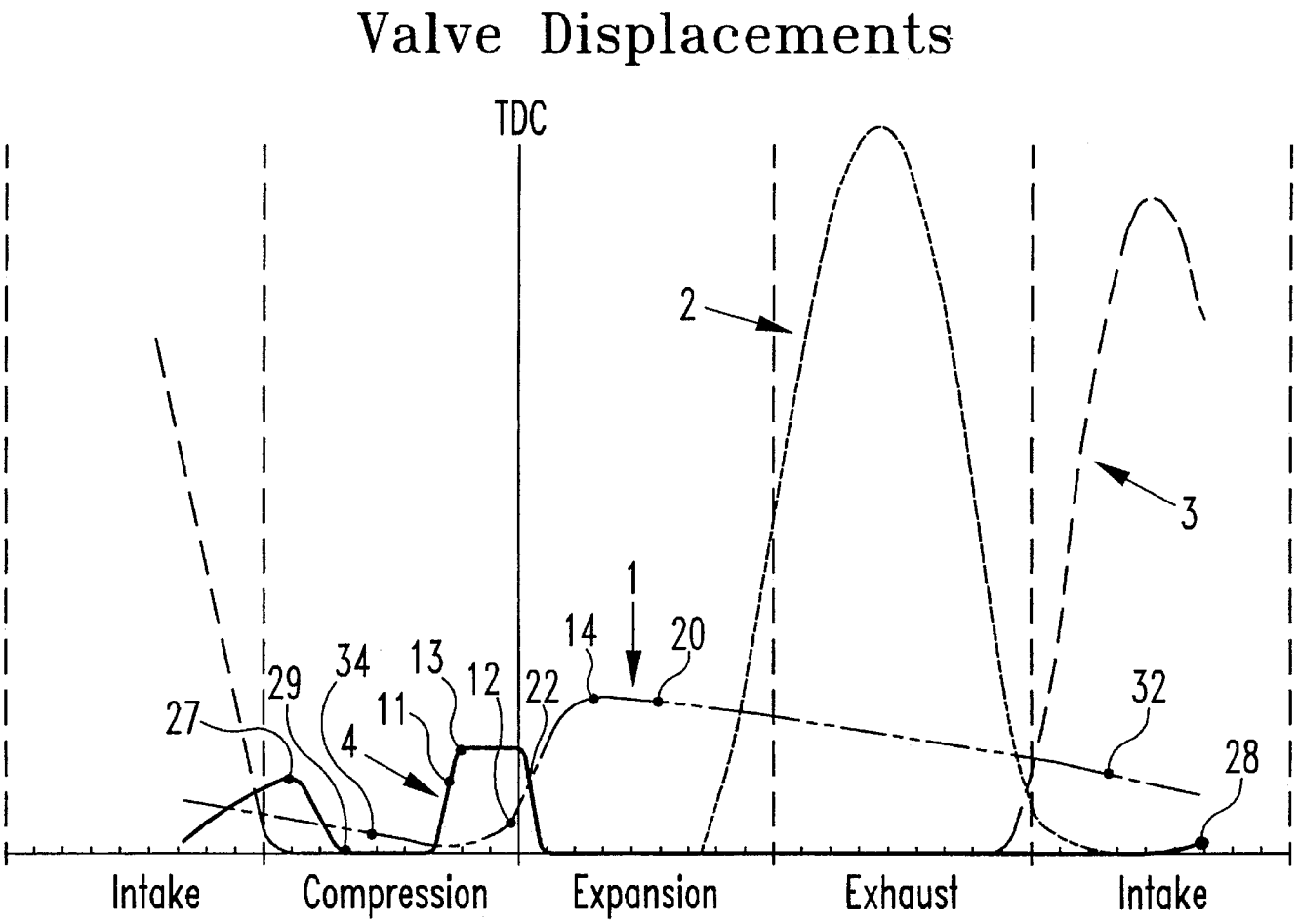
FIG. 1 is a graph of relative valve displacement versus engine crankshaft angle.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The improved engine retarding cycle of the present invention is achieved by displacing one or more exhaust valves or one or more dedicated retarder valves (both referred to as "a retarder valve" hereinafter) in a particular, predefined manner. FIG. 1 is a graph illustrating relative valve displacements versus crankshaft angle for a typical four stroke diesel engine (each stroke represents 180 degrees of crankshaft angular displacement). Curve 2 illustrates the normal displacement of an exhaust valve, curve 3 illustrates the normal displacement of an intake valve, while curve 1 illustrates the typical exhaust valve displacement for a prior art engine retarder running negative lash. In contrast to the prior art curve 1, curve 4 illustrates the retarder valve displacement necessary for the improved retarding cycle of the present invention. It will be appreciated by those skilled in the art that for the improved engine retarder cycle of the present invention, the normal intake and exhaust events are not modified. The improved engine retarder cycle of the present invention may best be understood by describing three separate sections of the cycle's operation: compression release, reset, and retarder intake.

Compression Release Section

The compression release section of the improved retarding cycle of the present invention is similar to a typical prior art retarder cycle in that retarding power is generated by compressing air during the compression stroke and then releasing that air to the exhaust manifold before the expansion stroke. However, the timing of the retarder valve is significantly altered in the present invention as compared to prior art retarder cycles. The prior art retarder valve displacement as illustrated in curve 1 begins opening the retarder valve at 12 just prior to top dead center, and the retarder valve is not fully open until the point 14, well into the expansion stroke. The retarder valve then remains basically wide open throughout the remainder of the expansion stroke.

By contrast, the improved retarder cycle of the present invention, as illustrated in curve 4 of FIG. 1, achieves an opening of the retarder valve much earlier in the compression stroke, as illustrated at point 11. The retarder valve reaches its peak displacement at point 13, well before top dead center, as contrasted to the retarder valve of the prior art, which reaches its full displacement at point 14, well after top dead center. Preferably, the retarder valve should begin to open during the second half of the compression stroke, become fully open (maximum displacement) 15–10 degrees before top dead center, begin to close during the expansion stroke, and be fully closed 15–20 degrees after top dead center. It will be appreciated by those skilled in the art that the exact timing of the compression release event will be dependent upon the particular engine design.

Figure 2:
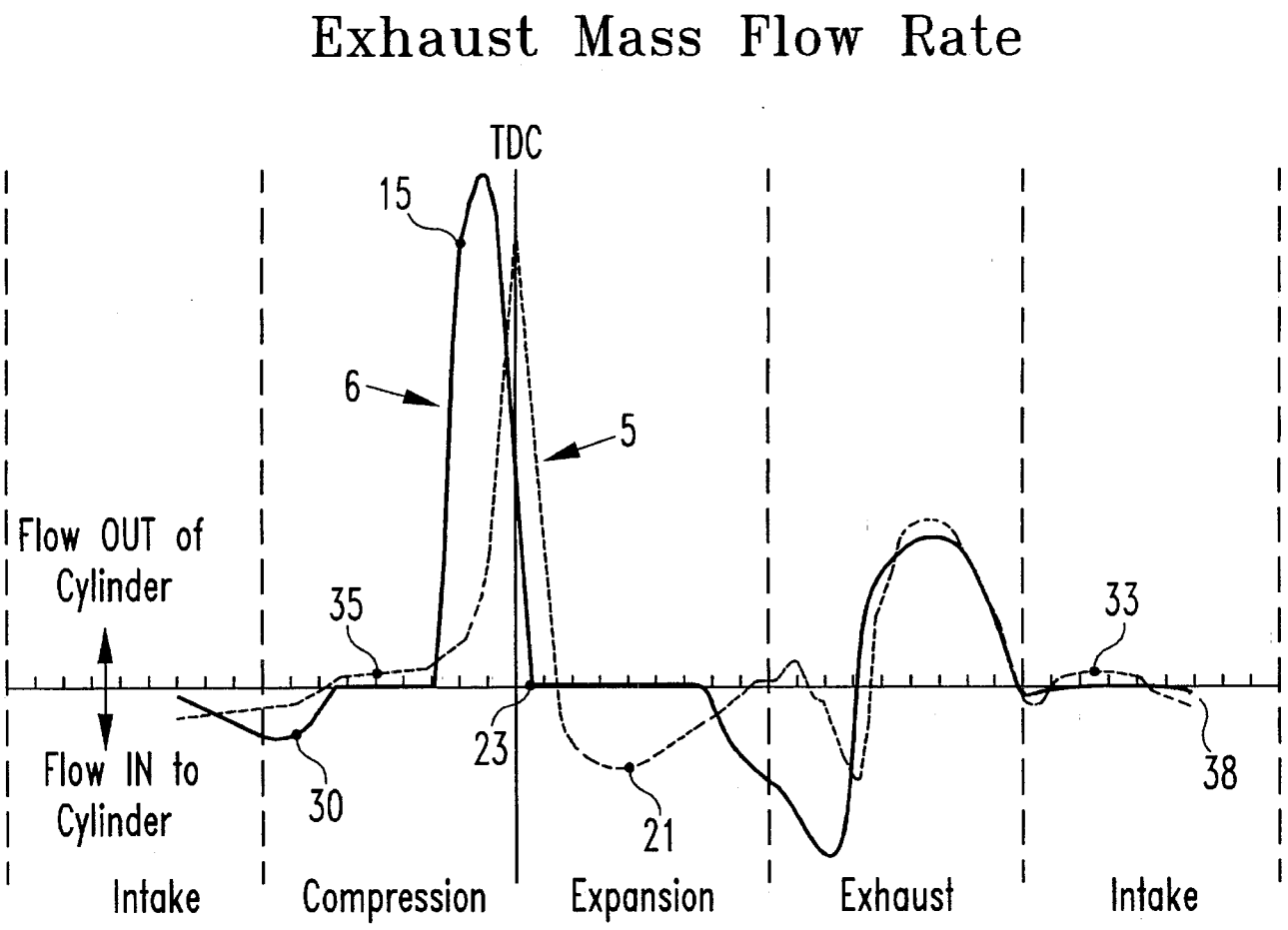
FIG. 2 is a graph of relative exhaust mass flow race versus engine crankshaft angle.
Figure 3:
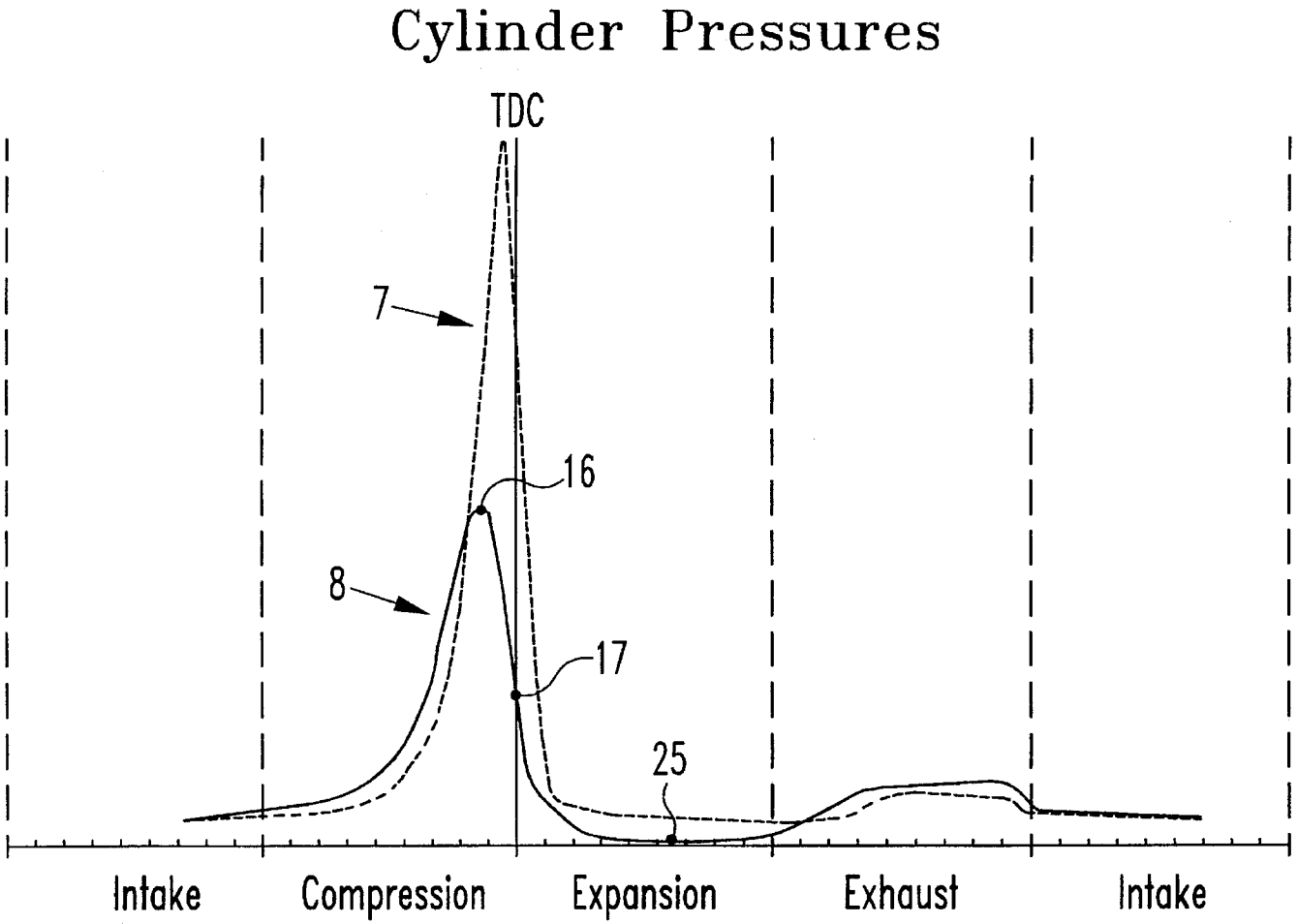
FIG. 3 is a graph of relative cylinder pressure versus engine crankshaft angle.
Figure 4:
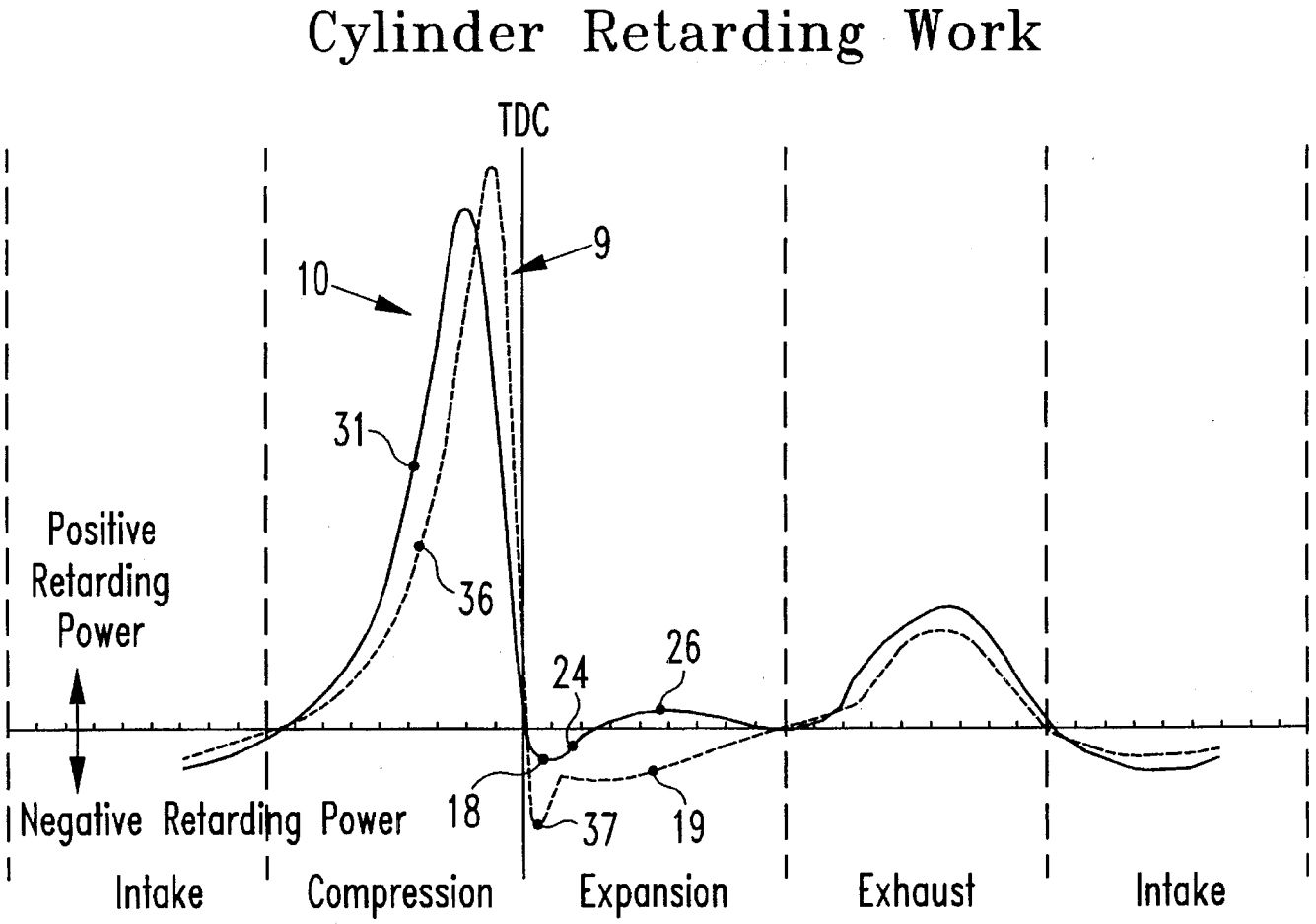
FIG. 4 is a graph of relative cylinder retarding work versus engine crankshaft angle.

FIG. 2 illustrates the mass flow rate of exhaust gas into and out of the cylinder as a function of crankshaft angle. As is clearly illustrated in FIG. 2, the earlier opening of the retarder valve in the engine retarding cycle of the present invention allows air to escape from the cylinder (in the region of point 15) much earlier than the prior art retarder valve tinting as represented by curve 5. FIG. 3 illustrates the pressure within the cylinder as a function of crankshaft angle. It can be seen in curve 8 that the engine retarding cycle of the present invention has a peak cylinder pressure 16 which is much lower than the peak cylinder pressure created by the retarder valve timing of the prior art, as represented by curve 7. This lower cylinder pressure allows less force to be exerted on the retarder valve in order to open it, thus reducing the mechanical loading on the engine. Allowing the air to escape from the cylinder earlier (FIG. 2, point 15) also reduces the cylinder pressure at top dead center and the start of the expansion stroke (FIG. 3, point 17). The result, as shown in FIG. 4, which graphs cylinder retarding work versus crankshaft angle, is that most of the pressure has been relieved from within the cylinder prior to the expansion stroke, thereby minimizing the negative retarding work performed by this pressure upon the piston (FIG. 4, point 18). By contrast, there is still significant cylinder pressure in the prior art engine retarding cycle at the start of the expansion stroke, thereby causing a rather large amount of negative retarding work at the start of the expansion stroke (FIG. 4, point 37). FIG. 4 therefore illustrates the reduction in negative retarding work achieved by the improved engine retarder cycle of the present invention.

Reset Section

The reset section of the improved engine retarding cycle of the present invention reduces or eliminates the negative retarding work that occurs during the expansion stroke of a typical prior art retarding cycle (the area surrounding point 19 in FIG. 4). FIGS. 1 and 2 show that the cause of this negative retarding work in the prior art engine retarding cycle is air flow back through the open exhaust valves (FIG. 1, point 20) and into the cylinder (FIG. 2, point 21), thus assisting in pushing the piston down into the cylinder. Such pushing helps to increase the power output of the engine, therefore it represents negative retarding work.

By contrast, the improved engine retarder cycle of the present invention closes the retarder valve (FIG. 1, point 22) at the point where reverse exhaust gas flow back through the retarder valve would occur (FIG. 2, point 23), thus reducing or eliminating the negative retarding work (FIG. 4, point 24) performed by the cylinder. Furthermore, if the retarder valve is closed shortly after top dead center and enough of the cylinder pressure has been bled out of the cylinder during the compression release section, movement of the engine piston downward in the cylinder during the expansion stroke will create a vacuum in the cylinder (FIG. 3, point 25), which creates additional positive retarding work (FIG. 4, point 26). This is not possible in the prior art retarder cycle due to the fact that the exhaust valve is held open during the entire expansion stroke, thereby precluding the creation of a vacuum in the cylinder.

With reference to FIG. 4, it will be appreciated by those skilled in the art that by reducing the amount of negative retarding work at point 18, and by producing positive retarding work in the region of point 26, the net retarding work performed during the entire expansion stroke will usually be positive, compared to the greatly negative retarding work experienced during the expansion stroke with the prior art curve 9. Furthermore, eliminating the reverse exhaust flow through the retarder valve also forces more of the air released from the cylinder during the compression stroke to flow through the turbocharger, thereby increasing the turbine speed and resulting in increased boost. This has beneficial effects on retarding work by increasing the amount of air flow into the cylinder during the retarder intake section, explained below.

Retarder Intake Section

Referring once again to FIG. 1, after closing the retarder valve at point 22 shortly after top dead center, the retarder valve remains closed throughout the remainder of the expansion stroke and the following exhaust stroke. The retarder intake section of the improved engine retarder cycle is a second opening of the retarder valve at the point 27, which begins midway through the normal intake valve event (FIG. 1, point 28) and ends during the first half of the compression stroke (FIG. 1, point 29). The optimum timing and displacement of the retarder intake event is dependent upon the particular engine configuration. This second retarder valve opening serves as an additional intake cycle. As the retarder valve is opened (FIG. 1, point 27), air flows back into the cylinder from the exhaust manifold FIG. 2, point 30). Thus, the cylinder is receiving air from both the intake manifold during the intake valve event and from the exhaust manifold during the retarder intake event. The additional air quantity in the cylinder during the compression stroke results in increased retarding work being performed earlier during this engine cycle (FIG. 4, point 31).

If the retarder valve is open too early in the intake stroke, as is the case with the prior art retarder cycle (FIG. 1, point 32), the initial flow of air is out of the cylinder rather than into the cylinder (FIG. 2, point 33), which in turn reduces the quantity of air that is in the cylinder during the compression stroke. This reduces the amount of positive retarding work performed by the engine during the compression stroke. Thus, in the improved retarder cycle of the present invention, the retarder valve begins to open for the retarder intake event (FIG. 1, point 28) when air from the exhaust manifold will flow into the cylinder, rather than out of the cylinder (FIG. 2, point 38). Also, it is important that the retarder valve be closed sometime during the first half of the compression stroke (FIG. 1, point 29). This is because if the retarder valve is left open too late in the compression stroke, as is the case with the prior art retarding cycle (FIG. 1, point 34), air will begin to escape from the cylinder (FIG. 2, point 35), lessening the amount of retarding work performed during this engine cycle (FIG. 4, point 36). Thus, the retarder intake event of the present invention is ended by closing the retarder valve at the point where air would begin to flow out of the cylinder (FIG. 1, point 29).

Of the three sections of the improved engine retarder cycle described herein, the retarder intake event has shown to have the most influence on increasing retarding work without also increasing mechanical loading on the engine. Simulations using the improved engine retarder cycle of the present invention on a 94N 14-500E engine, manufactured by Cummins Engine of Columbus, Ind., exhibited a retarding power increase of 36% while reducing the exhaust valve crosshead load by 41% as compared to the conventional "C Brake" compression brake commercially available for this engine.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An engine retarder cycle for operation of an engine brake, comprising the steps of:

(a) beginning to open a retarder valve in an engine cylinder during a second half of a compression stroke of a piston in the engine cylinder;

(b) opening the retarder valve to a maximum displacement prior to a top dead center position of the piston; and (c) closing the retarder valve during a first half of all expansion stroke of the piston.

2. The engine retarder cycle of claim 1, wherein the retarder valve is one or more exhaust valves in the engine cylinder.

3. The engine retarder cycle of claim 1, wherein step further comprises opening the retarder valve to the maximum displacement before ten degrees prior to the top dead center position.

4. The engine retarder cycle of claim 1, wherein step (c) further comprises closing the retarder valve before twenty degrees after the top dead center position.

5. The engine retarder cycle of claim 1, wherein step further comprises closing the retarder valve past the top dead center position substantially at a point where reverse exhaust gas flow back through the retarder valve would occur if the retarder valve were not closed.

6. An engine retarder cycle for operation of an engine brake, comprising the steps of:

(a) opening a retarder valve in all engine cylinder prior to a top dead center position of a piston in the engine cylinder; and (b) closing the retarder valve past the top dead center position substantially at a point where reverse exhaust gas flow back through the retarder valve would occur if the retarder valve were not closed.

7. The engine retarder cycle of claim 6, wherein the retarder valve is one or more exhaust valves in the engine cylinder.

8. The engine retarder cycle of claim 6, wherein step (b) further comprises closing the retarder valve during at least a portion of an expansion stroke of the piston.

9. The engine retarder cycle of claim 6, wherein step (b) further comprises closing the retarder valve before twenty degrees after the top dead center position.

10. The engine retarder cycle of claim 6, wherein step (a) further comprises opening the retarder valve to a maximum displacement before ten degrees prior to the top dead center position.

11. An engine retarder cycle for operation of an engine brake, comprising the steps of:

(a) maintaining a retarder valve in an engine cylinder in a closed position during an entire exhaust stroke of a piston in the engine cylinder;

(b) opening the retarder valve during an intake stroke of the piston; and (c) closing the retarder valve during a first half of a compression stroke of the piston.

12. The engine retarder cycle of claim 11, wherein the retarder valve is one or more exhaust valves in the engine cylinder.

13. The engine retarder cycle of claim 11, wherein step (b) further comprises opening the retarder valve during a second half of the intake stroke.

14. The engine retarder cycle of claim 11, wherein step (b) further comprises opening the retarder valve during the intake stroke substantially at a point where reverse exhaust gas flow back through the retarder valve will occur.

15. The engine retarder cycle of claim 11, wherein step (c) further comprises closing the retarder valve during the compression stroke substantially at a point where exhaust gas flow out of the cylinder would occur if the retarder valve were not closed.

16. An engine retarder cycle for operation of an engine brake, comprising the steps of:

(a) beginning to open a retarder valve in an engine cylinder during a second half of a compression stroke of a piston in the engine cylinder;

(b) opening the retarder valve to a maximum displacement prior to a top dead center position of the piston;

(c) closing the retarder valve during a first half of an expansion stroke of the piston;

(d) maintaining the retarder valve in a closed position during a remainder of the expansion stroke;

(e) maintaining the retarder valve in the closed position during an entire exhaust stroke of the piston;

(f) opening the retarder valve during an intake stroke of the piston; and (g) closing the retarder valve during a first half of a compression stroke of the piston.

17. The engine retarder cycle of claim 16, wherein the retarder valve is one or more exhaust valves in the engine cylinder.

18. The engine retarder cycle of claim 16, wherein step (c) further comprises closing the retarder valve past the top dead center position substantially at a point where reverse exhaust gas flow back through the retarder valve would occur if the retarder valve were not closed.

19. The engine retarder cycle of claim 16, wherein step (f) further comprises opening the retarder valve during the intake stroke substantially at a point where reverse exhaust gas flow back through the retarder valve will occur.

20. The engine retarder cycle of claim 16, wherein step (g) further comprises closing the retarder valve during the compression stroke substantially at a point where exhaust gas flow out of the cylinder would occur if the retarder valve were not closed.

* * * * *

UNITED STATES PATENT AND TRADEMARK OFFICE

CERTIFICATE OF CORRECTION

PATENT NO. : 5,586,531

DATED : December 24, 1996

INVENTOR(S) : David A. Vittorio

It is certified that error appears in the above-identified patent and that said Letters Patent is hereby corrected as shown below:

In column 1, line 18, please change "elates" to --relates--.

In column 1, line 39, please change "tile" to --the--.

In column 1, line 57, please change "ill" to --in--.

In column 1, line 57, please change "all" to --an--.

In column 2, line 19, please delete "8".

In column 2, line 57, please change "race" to --rate--.

UNITED STATES PATENT AND TRADEMARK OFFICE

CERTIFICATE OF CORRECTION

PATENT NO. : 5,586,531

DATED : December 24, 1996

INVENTOR(S) : David A. Vittorio

It is certified that error appears in the above-identified patent and that said Letters Patent is hereby corrected as shown below:

In column 3, line 66, please change "tinting" to --timing--.

In column 5, line 12, , please add --(-- after "manifold".

In column 6, line 1, change "all" to --an--.

In column 6, line 6, please insert --(b)-- after "step".

In column 6, line 13, please insert --(c)-- after "step".

In column 6, line 20, please change "all" to --an--.

Signed and Sealed this

Ninth Day of December, 1997

*Attest:*

*Attesting Officer*

Bruce Lehman

BRUCE LEHMAN

*Commissioner of Patents and Trademarks*